US006081944A

United States Patent [19]

Edwards

[11] Patent Number: 6,081,944

[45] Date of Patent: Jul. 4, 2000

[54] SWIMMING POOL SCREEN ENCLOSURE SUPPORTED WATER MISTING AND COOLING APPARATUS

[76] Inventor: Hugh A. Edwards, 4004 Cape Vista Dr., Bradenton, Fla. 34209

[21] Appl. No.: 09/150,308

[22] Filed: Sep. 9, 1998

[51] Int. Cl.[7] ..... E04H 4/00

[52] U.S. Cl. ..... 4/496; 4/488; 4/615; 239/209; 239/289

[58] Field of Search ..... 4/496, 488, 615, 4/601, 567, 568, 570; 239/209, 208, 289, 266; 47/17, 26, 48.5; 248/231.85, 228.5, 228.8, 228.7, 228.1, 231.21, 231.61, 63, 339, 341

[56] References Cited

U.S. PATENT DOCUMENTS

| | | | |
|---|---|---|---|
| 917,157 | 4/1909 | Sandham | 4/568 |
| 2,438,085 | 3/1948 | Woodings et al. | 248/228.1 |
| 3,337,136 | 8/1967 | Strenkert | 239/209 |
| 3,521,842 | 7/1970 | Opperthauser | 248/231.21 |
| 3,606,157 | 9/1971 | Chapin . | |
| 3,831,852 | 8/1974 | Stillman . | |
| 4,788,791 | 12/1988 | Sprung | 47/17 |
| 4,791,993 | 12/1988 | Curran | 239/209 |
| 4,834,186 | 5/1989 | Ballard | 239/209 |
| 5,000,384 | 3/1991 | Arnold | 239/289 |
| 5,165,628 | 11/1992 | Todd et al. | 248/62 |
| 5,201,857 | 4/1993 | Nix . | |
| 5,217,161 | 6/1993 | Souza . | |
| 5,330,104 | 7/1994 | Marcus | 239/266 |
| 5,469,587 | 11/1995 | Demeny | 4/315 |
| 5,497,633 | 3/1996 | Jones et al. | 62/314 |
| 5,540,383 | 7/1996 | Ducey | 239/289 |
| 5,598,719 | 2/1997 | Jones et al. | 62/304 |
| 5,765,699 | 6/1998 | Griffin | 211/70.6 |
| 5,768,843 | 6/1998 | Dziedzic | 52/506.06 |
| 5,785,204 | 7/1998 | Thompson et al. | 221/24 |
| 5,813,641 | 9/1998 | Baldwin | 248/223 |
| 5,862,990 | 1/1999 | White | 239/289 |
| 6,015,099 | 1/2000 | Ducey | 239/266 |

FOREIGN PATENT DOCUMENTS

| | | | |
|---|---|---|---|
| 6-170293 | 6/1994 | Japan | 239/289 |

OTHER PUBLICATIONS

Niagra Mist Outdoor Cooling System Brochure, No Date.
Crative Mist Systems Inc. Brochure, No Date.
Mist –Cooling Brochure, No Date.

*Primary Examiner*—David J. Walczak
*Attorney, Agent, or Firm*—Charles J. Prescott

[57] ABSTRACT

A swimming pool screen enclosure-supported water misting and cooling apparatus, the screen enclosure including tensioned fabric screen panels held between spaced apart elongated upright and overhead rigid frame members. The apparatus includes a plurality of water misting nozzles each of which discharge water under pressure as a very fine mist. A flexible water tubing is operably connectable to each misting nozzle for delivering pressurized water to each misting nozzle, the water tubing being connectable to a pressurized water source. A plurality of retaining clips are each connectable to an overhead frame member to support the misting nozzles and water tubing overhead of the swimming pool and adjacent deck area within the screen enclosure whereby mist discharging from the misting nozzles is distributed downwardly to cool occupants within the screen enclosure without substantially wetting any of the screen enclosure contents.

6 Claims, 4 Drawing Sheets

SWIMMING POOL SCREEN ENCLOSURE SUPPORTED WATER MISTING AND COOLING APPARATUS

BACKGROUND OF THE INVENTION

1. Scope of Invention

This invention relates generally to swimming pool enclosures in the form of screened pool cages, and more particularly to an apparatus attachable to the framework of such swimming pool cage enclosures which dispenses a very fine mist over the enclosed area for cooling occupants therein.

2. Prior Art

A number of devices are known to applicant which spray either swimming pool water or fresh water into or adjacent a swimming pool primarily for visual effects or for water level replenishment within the swimming pool itself. The following U.S. patents apply thereto:

U.S. Pat. No. 5,201,857 to Nix

U.S. Pat. No. 5,217,161 to Souza

U.S. Pat. No. 3,831,852 to Stillman

However, none of the above prior art inventions teach the downward discharging of water mist over the enclosed area only for cooling individuals or other such beneficial purposes.

Chapin, in U.S. Pat. No. 3,606,157 teaches a suspended watering system which suspends an elongated water supplying main from a tensioned cable, the main being provided with a series of upstanding spray nozzles connected thereto, the nozzles being independently supported for proper orientation and discharge of water for irrigation purposes.

In U.S. Pat. No. 4,788,791, Sprung has invented a cooling system for greenhouse structures which is attached to the outside surface of a greenhouse translucent screen fabric panel so that water spray is applied to the outer surfaces of the translucent screen fabric for cooling of the greenhouse structure.

There appears to be a need for an apparatus which dispenses a highly atomized very fine mist into the enclosed area of a swimming pool cage which typically gets quite hot during the warmer seasonal months. By the dispensing of a highly atomized mist, both the air and the occupants in the enclosure are cooled thereby as the mist or highly vaporized water more quickly evaporates than does any other form of the water such as when sprayed or spinkled into the pool cage area for irrigation purposes. The present invention responds fully to this need

BRIEF SUMMARY OF THE INVENTION

This invention is directed to a swimming pool screen enclosure-supported water misting and cooling apparatus, the screen enclosure including tensioned fabric screen panels held a between spaced apart elongated upright and overhead rigid frame members. The apparatus includes a plurality of water misting nozzles each of which discharge pressurized water as a very fine mist. A flexible water (micro) tubing is operably connectable to each retaining clip supported misting nozzle for delivering pressurized water to each misting nozzle, the water tubing being connectable to a pressurized water source. The retaining clips are each connectable to one overhead frame member to support the misting nozzles and water tubing overhead of the swimming pool and adjacent deck area within the screen enclosure whereby mist discharging from the misting nozzles is distributed downwardly to cool occupants within the screen enclosure by evaporation substantially before contact thus avoiding substantial water buildup.

It is therefore an object of this invention to provide an apparatus for dispersing a highly atomized very fine mist of water vapor into the enclosed area of a screened-in swimming pool cage or enclosure which cools occupants by evaporation without substantially wetting any surfaces within the enclosure.

It is yet another object of this invention to provide an easily installable system for dispersing very fine mist into the swimming pool screened enclosure around the swimming pool for cooling of occupants therein.

It is still another object of this invention to provide a variety of attaching or retaining clips for supporting an apparatus for dispensing cooling mist into a screened enclosure of a swimming pool, the retaining clips easily mechanically or adhesively attachable to the existing framework structure of the screened swimming pool enclosure.

In accordance with these and other objects which will become apparent hereinafter, the instant invention will now be described with reference to the accompanying drawings.

DETAILED DESCRIPTION OF THE INVENTION

Figure 1:
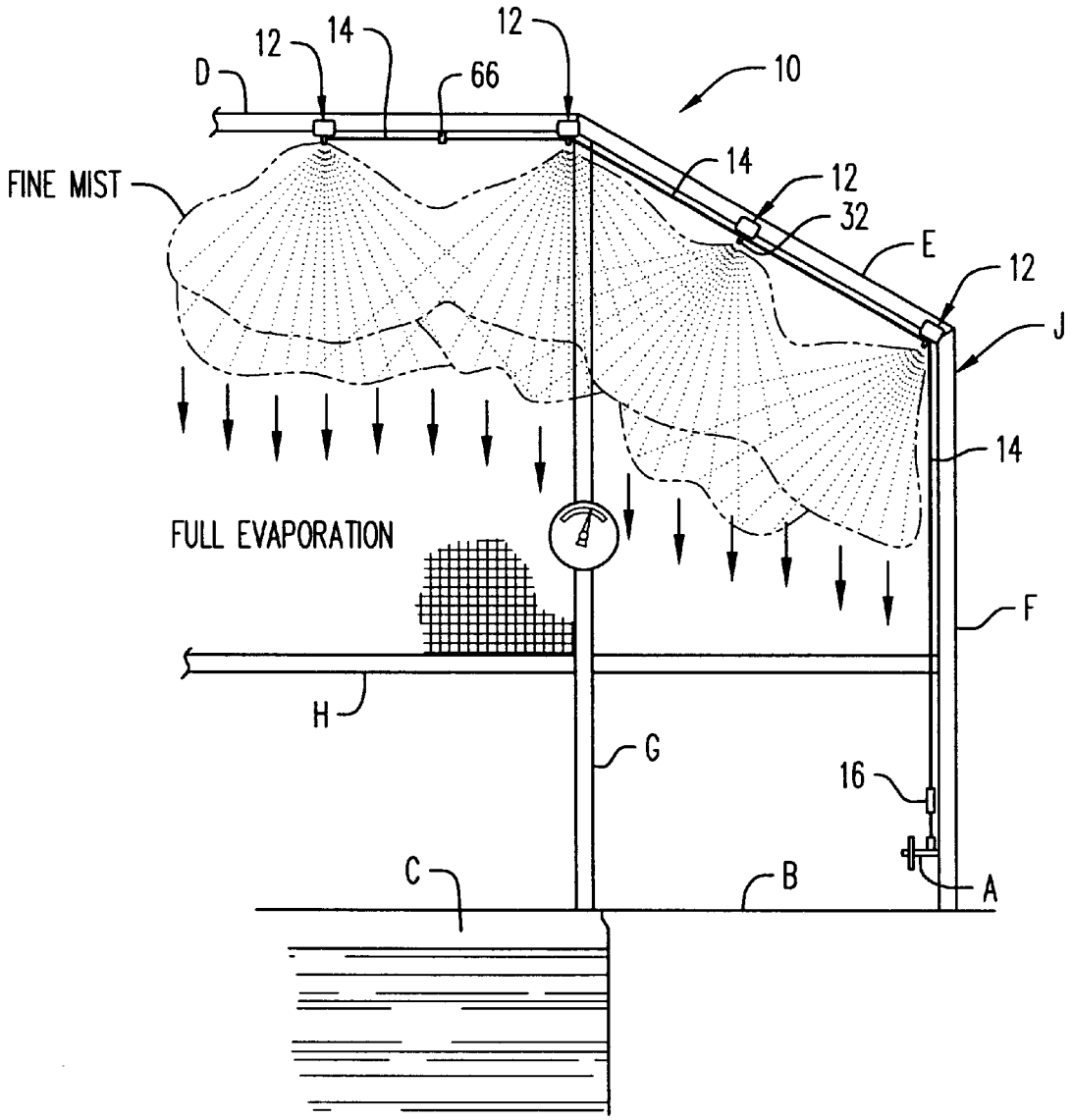
FIG. 1 is a side elevation interior view of a portion of a screen enclosure surrounding a the swimming pool and adjacent deck area.
Figure 2:
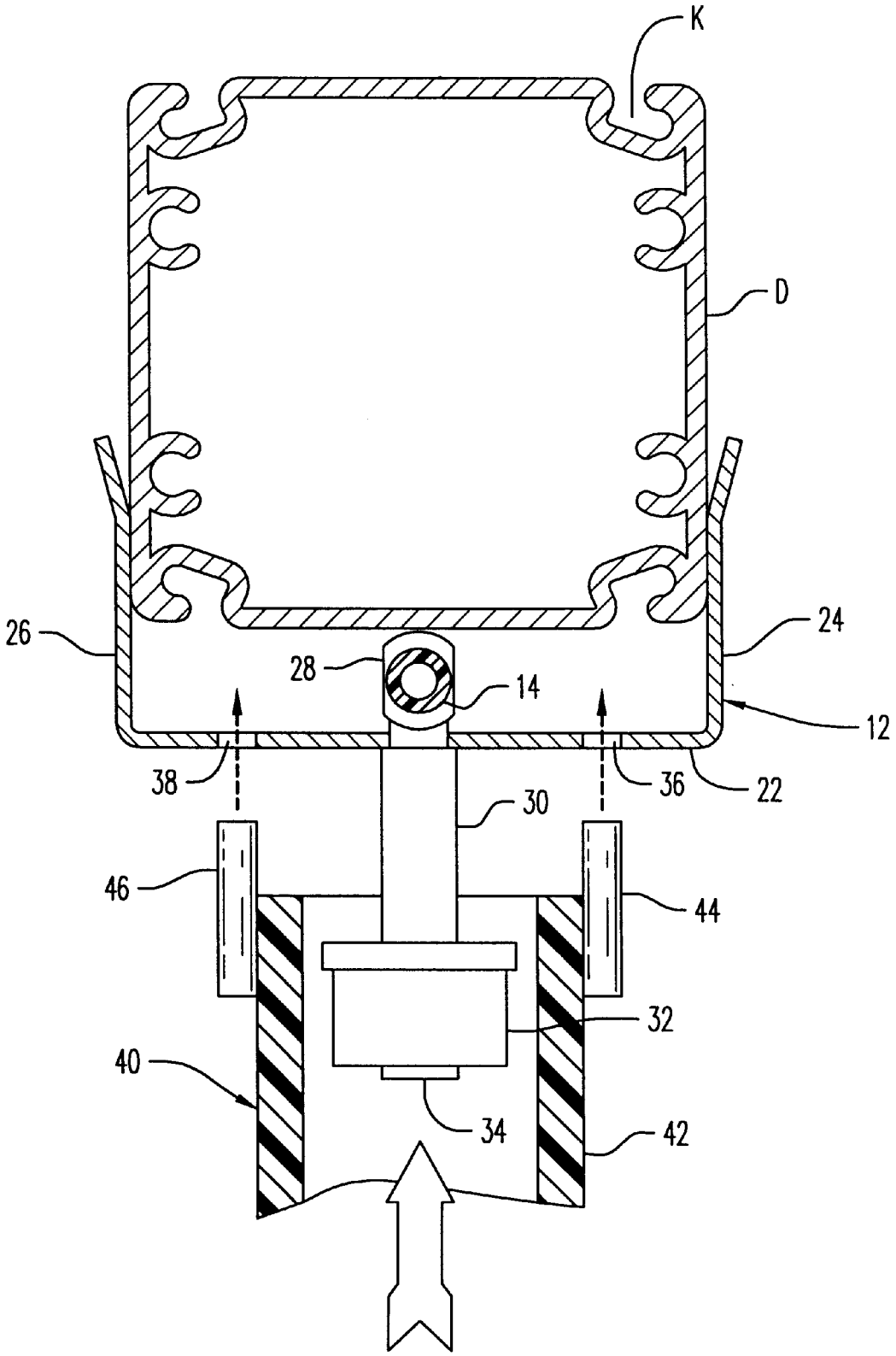
FIG. 2 is a typical cross section view through one frame member of the swimming pool cage or enclosure showing the preferred embodiment of the retaining clip and supportively connected misting nozzle and water conduit and further showing a separate elongated retaining clip installation tool used to facilitate apparatus installation while standing on the deck area or in the pool.

Referring now to the drawings, the preferred embodiment of the invention is shown in FIG. 1 generally at numeral 10 and includes a plurality of retaining clip assemblies 12 as best seen in FIG. 2, each of which include a generally U-shaped clip or bracket 22 which is attached and inwardly (or downwardly) extends from one elongated rigid frame member D or E of a frame structure of a swimming pool cage or enclosure shown generally at numeral J. Opposing side portions 24 and 26 biasingly engage against the side surfaces of the frame member D for support, which support may be increased by the addition of a rubber sheet or adhesive strips.

Each of the retaining clip assemblies 12 include and support one fogger or misting nozzle 32 as best seen in FIG. 2. These misting nozzles 32 are commercially available from the Dig Corporation of San Marcos, Calif. in various sizes and degrees of water atomization, P/N43 fogger being preferred.

A length of flexible water (micro) tubing or conduit 14 (also available from Dig Corporation) is interconnected between each misting nozzle 32 and then connected at a lower end thereof to a supply of pressurized water from valve A. To insure proper pressurization, a regulating valve 16 which maintains a desired pressure and water flow rate is also provided. The preferred water pressure is a maximum of about 50 p.s.i. and preferably in the range of 25–30 p.s.i. Although fresh water is the preferred source of pressurized water from a municipal water supply, to conserve on fresh water use, an alternate water supply may be obtained by tapping into the outlet side of a water filter and circulation system (not shown) of a swimming pool C. Each said misting nozzle 32 delivers about 4–5 g.p.h. (gallons per hour) at 25–30 p.s.i.

To facilitate installation of each retaining clip assembly 12 which also preferably carries a misting nozzle 32, an elongated retaining clip installation device 40 as best seen in FIG. 2 is provided. This installation device 40 includes spaced prongs or locating dowels 44 and 46 which axially extend from the distal end of an elongated lightweight plastic tubular handle 42. The interior or inside diameter of the handle 42 is sized to somewhat closely fit around the outer periphery or diameter of the misting nozzle 32 to assist in the alignment of prongs 44 and 46 into mating holes 36 and 38 formed into the retaining clip 22. Once the retaining clip 22 has been forcibly urged into the position shown in FIG. 2 and attached to the inward portion of the frame member D, the installation member 40 may be removed. By this accessory, an installer may stand on the deck area B of the swimming pool C (or in the pool) within the enclosure J of FIG. 1 and easily properly install each of the retaining clip assemblies 12. A lower end (not shown) of the installation device 40 may be connected to another expandable pole for greater reach, if necessary.

Figure 3:
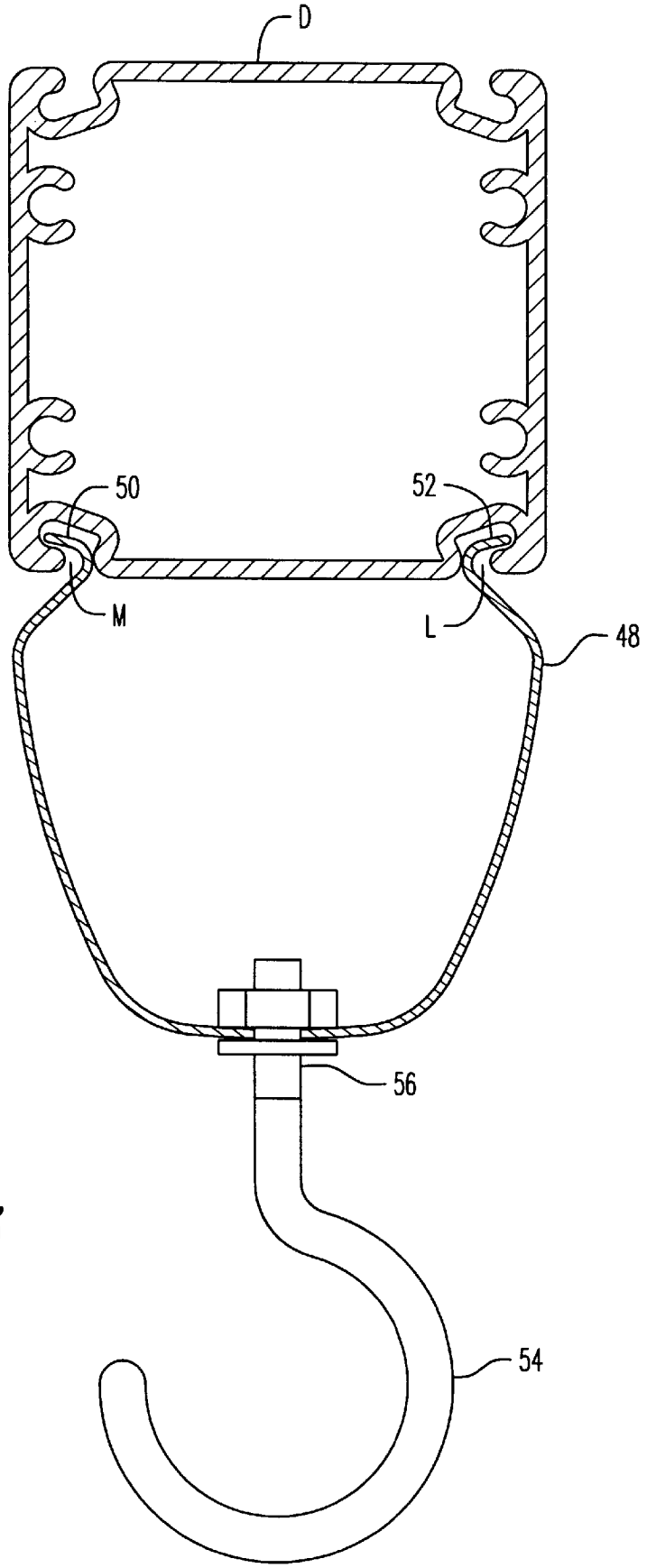
FIG. 3 is another cross section view taken through a typical frame member showing another embodiment of a retaining clip releasably attached thereto.
Figure 4:
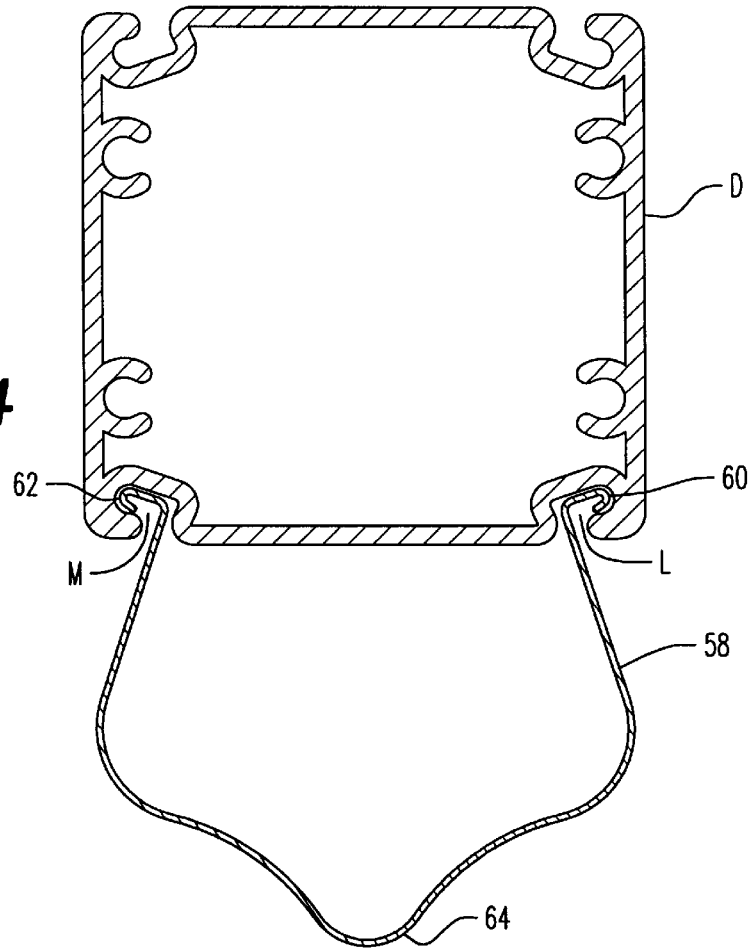
FIGS. 4 and 5 are section views similar to that of FIG. 3 showing still further embodiments of releasably engaged retaining clips.
Figure 5:
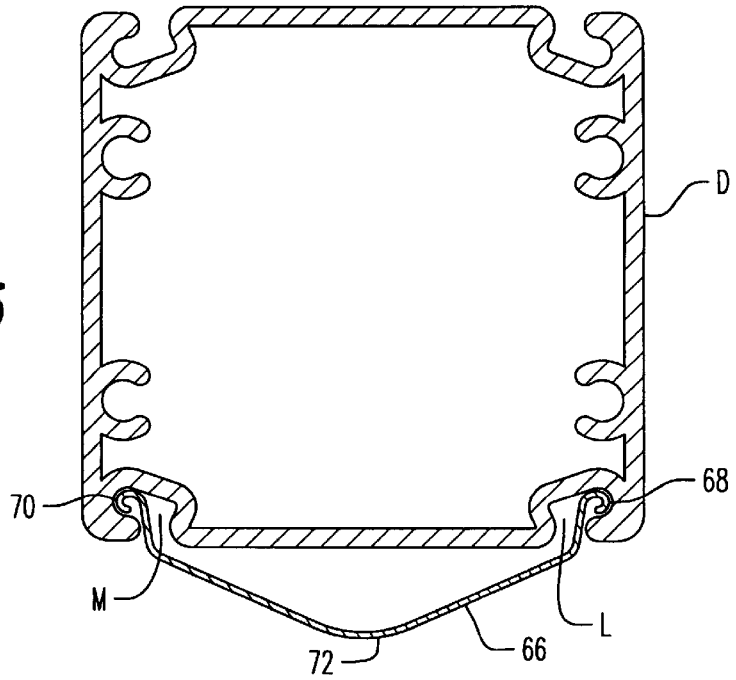

Referring now to FIGS. 3 to 5, alternate embodiments of retaining clips are shown at 48, 58 and 66, respectively. Each of these retaining clips 48, 58 and 66 are formed of resilient semirigid material such as aluminum, stainless steel or plastic material with formed ends which mechanically engage and are biasingly held within channels L and M formed inwardly along the comers of each of the frame members D. These channels L and M are typically provided in the frame members D for the alternate intended purpose of retaining an edge of a flexible screen panel and ribbing material which locks the edge of the screen panel in place in a well-known manner.

Thusly, retaining clip 48 by its formed ends 50 and 52 mechanically and biasingly engage these grooves L and M while formed ends 60 and 62 of clip 58 and 68 and 70 of clip 66 accomplish this same releasable connection thereby.

Retaining clip 48 includes a hook 54 connected at 56 to the central lower portion of retaining clip 48. This hook 54 may be utilized for supporting plants and other items of ornamentality and the like as desired within a swimming pool cage enclosure. Clips 58 and 66 which include a downwardly formed central portion 64 and 72, respectively will support a segment of the water tubing 14 passed therethrough. Clip 66 is shown in a typical position in FIG. 1 for supporting longer portions of the water tubing 14.

As previously noted, the primary purpose of the present invention is to dispense a cloud of finely vaporized mist into the air within the confines of a swimming pool screen enclosure. The invention takes advantage of the existing or included framework structure of such caged enclosures shown typically at J in FIG. 1. By dispensing this finely atomized mist from essentially overhead within the screen enclosure, almost full evaporation of the mist occurs before it would settle onto any contents within the screened enclosure such as chaise lounges, tables, towels and other things typically found within such screened enclosures. The substantially full airborne evaporation of this fine mist occurring about the occupants, even when seated, cools the surrounding air rapidly and also may lightly collect to cool the skin of the occupants as well.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A swimming pool screen enclosure-supported water misting and cooling apparatus, the screen enclosure including tensioned fabric screen panels held between spaced apart elongated rigid frame members, said apparatus comprising:

a plurality of water misting nozzles each of which discharge only water under pressure as a very fine mist;

flexible water tubing operably connected to each said misting nozzle for delivering pressurized water to each said misting nozzle;

one end of said water tubing connected to a pressurized water source;

a plurality of retaining clips each connectable to an outer surface of one frame member and supporting said misting nozzles and said water tubing overhead of the swimming pool and adjacent deck area within the screen enclosure whereby mist discharging from said misting nozzles is distributed to cool occupants within the screen enclosure and a retaining clip installation member having an end portion which releasably engages with mating receiving structure of each said retaining clip and an internal cavity adapted to receive said misting nozzles whereby each said retaining clip releasably engaged onto said end portion may be manually installed and engaged on one frame member.

2. A swimming pool screen enclosure-supported water misting and cooling apparatus as set forth in claim 1, wherein:

each said retaining clip clampingly engages against opposing outside surfaces of one frame member for frictional support thereby.

3. A swimming pool screen enclosure-supported water misting and cooling apparatus, the screen enclosure including tensioned fabric screen panels held between spaced apart elongated rigid frame members, said apparatus comprising:

a plurality of water misting nozzles each of which discharge only pressurized water as a very fine mist sufficiently atomized and of a limited flow volume such that said mist substantially evaporates before substantial moisture accumulation on any contents within the screened enclosure;

flexible water tubing operably connectable to a pressurized water source for delivering pressurized water to each said misting nozzle;

a plurality of retaining clips each connected an outer surface of to connectable one frame member for supporting said misting nozzles and said water tubing overhead of the swimming pool and adjacent deck area within the screen enclosure whereby mist discharging from said misting nozzles is distributed substantially only to cool occupants within the screen enclosure and a retaining clip installation member having an end portion which releasably engages with mating receiving structure of each said retaining clip and an internal cavity adapted to receive said misting nozzles whereby each said retaining clip releasably engaged onto said end portion may be manually installed and engaged on one frame member.

4. A swimming pool screen enclosure-supported water misting and cooling apparatus as set forth in claim 3 wherein:

each said retaining clip clampingly engages against opposing outside surfaces of one frame member for frictional support thereby.

5. A swimming pool screen enclosure-supported water misting and cooling apparatus, the screen enclosure including tensioned fabric screen panels held between spaced apart elongated rigid frame members, said apparatus comprising:

a plurality of water misting nozzles each of which discharge only water under pressure as a very fine mist;

flexible water tubing operably connectable to each said misting nozzle for delivering pressurized water to each said misting nozzle;

means for connecting said water tubing to a pressurized water source;

a plurality of generally U-shaped clamping brackets each connectable to an outer surface of one frame member and connectedly supporting one said misting nozzle and said water tubing overhead of the swimming pool and adjacent deck area whereby mist discharging from said misting nozzles is distributed substantially only to cool occupants within the screen enclosure and a retaining clip installation member having an end portion which releasably engages with mating receiving structure of each said retaining clip and an internal cavity adapted to receive said misting nozzles whereby each said retaining clip releasably engaged onto said end portion may be manually installed and engaged on one frame member.

6. A swimming pool screen enclosure-supported water misting and cooling apparatus as set forth in claim 5 wherein:

each said retaining clip clampingly engages against opposing outside surfaces of one frame member for frictional support thereby.

* * * * *

UNITED STATES PATENT AND TRADEMARK OFFICE

CERTIFICATE OF CORRECTION

PATENT NO. : 6,081,944

DATED : Jul. 4, 2000

INVENTOR(S) : Hugh A. Edwards

It is certified that error appears in the above-indentified patent and that said Letters Patent is hereby corrected as shown below:

Column 4, lines 54 and 55, replace "connected an outer surface of to connectable" with -- connectable to an outer surface of --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*